US005515784A

United States Patent [19]

Peebles

[11] Patent Number: 5,515,784

[45] Date of Patent: May 14, 1996

[54] SIGNAL TRANSMISSION DEVICES AND DETONATION SYSTEMS USING THE SAME

[75] Inventor: Richard J. Peebles, Winchester, Conn.

[73] Assignee: The Ensign-Bickford Company, Simsbury, Conn.

[21] Appl. No.: 291,961

[22] Filed: Aug. 9, 1994

[51] Int. Cl.[6] ..... C06C 5/06

[52] U.S. Cl. ..... 102/275.3; 102/275.4; 102/275.7

[58] Field of Search ..... 102/200, 275.2, 102/275.3, 275.4, 275.5, 275.6, 275.7, 275.8, 275.9, 311, 335, 360

[56] References Cited

U.S. PATENT DOCUMENTS

| | | | |
|---|---|---|---|
| 3,590,739 | 7/1971 | Persson . | |
| 3,885,499 | 5/1975 | Hurley | 102/275.9 |
| 3,939,772 | 2/1976 | Zebree | 102/275.9 |
| 3,981,240 | 9/1976 | Gladden . | |
| 3,987,732 | 10/1976 | Spraggs et al. . | |
| 4,073,235 | 2/1978 | Hopler, Jr. | 102/200 |
| 4,328,753 | 5/1982 | Kristensen et al. . | |
| 4,607,573 | 8/1986 | Thureson et al. . | |
| 4,757,764 | 7/1988 | Thureson et al. . | |
| 4,911,076 | 3/1990 | Rowe . | |

*Primary Examiner*—Charles T. Jordan
*Assistant Examiner*—Theresa M. Wesson
*Attorney, Agent, or Firm*—Victor E. Libert; Frederick A. Spaeth

[57] ABSTRACT

Signal transmission devices contain within a housing (12) at least a pair of signal transmission lines, e.g., signal transmission tubes (16, 18) having respective tube ends (16*a*, 18*a*) disposed within the housing to provide at least one input tube and at least one output tube. Delay train means (22) are interposed between at least one of the tubes and a detonator charge (20) contained at the closed or active end (12*a*) of the housing. Alternatively, both the input and output tubes may have a delay train (22', 22") interposed between it and the detonator charge. In another embodiment, a signal transfer charge (28) may connect the input and output tubes (16", 18") in signal transfer relation to each other. In operation, selected delays may be attained between initiation of the detonator charge and one or both of ignition of the delay train means and generation of an output relay signal in the output tube. A plurality of relay and initiator devices (34) may be connected in sequence by signal transfer connectors (46) connecting tubes (42, 40) in signal transfer relationship.

21 Claims, 2 Drawing Sheets

SIGNAL TRANSMISSION DEVICES AND DETONATION SYSTEMS USING THE SAME

BACKGROUND OF THE INVENTION

1. Field of the Invention

This invention relates to devices for the transmission of signals for initiation of detonations, and more particularly to signal transmission relay and initiation devices for delayed transmission of pyrotechnic or detonation initiation signals.

2. Related Art

The prior art is well aware of the use of signal transmission lines, such as signal transmission tubes, to transfer initiation signals to initiate pyrotechnic or detonation events and the use of pyrotechnic delays to help time the occurrence of such events.

Signal transmission lines, i.e., fuses, of the type disclosed in U.S. Pat. No. 3,590,739 issued Jul. 6, 1971 to P. A. Persson, U.S. Pat. No. 4,328,753, issued May 11, 1982 to L. Kristensen et al and U.S. Pat. No. 4,607,573 issued Aug. 26, 1986 to G. R. Thureson et al comprise signal transmission tubes and are commonly referred to as "shock tubes". Shock tubes comprise an elongated hollow tube made of one or more layers of synthetic organic polymeric material(s) (plastics) containing on the interior wall thereof a thin coating of reactive material such as a pulverulent mixture of a high brisance explosive and reducing agent, for example, a mixture of PETN, HMX, RMX or the like, and aluminum powder. The tube is hollow, providing an open channel or bore extending the length of the tube. When the reactive material is ignited, as by a spark igniter or a detonator cap used as a signal-transmitter, or by any other suitable means, ignition of the reactive material propagates an initiation signal through the open bore of the tube.

U.S. Pat. No. 4,757,764, issued Jul. 19, 1988 to G. R. Thureson et al discloses low velocity signal transmission ("LVST") tubes comprising plastic tubes as described above except that the reactive material is a low velocity deflagrating material, e.g., manganese/potassium perchlorate, silicon/red lead, zirconium/ferric oxide, etc., instead of an explosive powder of high brisance. The deflagrating material provides a speed of transmission of the initiation signal propagated through the tube of about one-third that of shock tubes.

The connection of shock tube initiator devices in series or other sequence is shown, for example, in R. W. Spraggs U.S. Pat. No. 3,987,732.

The use of static electricity dissipation means, such as isolation members, in non-electric detonator caps which are to be assembled to fuses of a type capable of transmitting a static electric charge, e.g., a shock tube or LVST tube, is known in the art, as shown in U.S. Pat. No. 3,981,240, issued Sept. 21, 1976 to E. L. Gladden.

U.S. Pat. No. 4,911,076 to Rowe, dated Mar. 27, 1990, discloses a signal delay device comprising a delay detonator cap connected to a pair of shock tubes. Portions of both shock tubes are disposed externally of the cap in close proximity to the closed, output end of the cap, i.e., the active end of the cap. One end of each shock tube is disposed in the detonator cap shell in signal transfer relation to the delay element. An incoming signal in either shock tube can initiate the delay element, but the shock tubes have sealed ends so that one shock tube cannot fire the other and the burning of the delay element will not initiate a signal in the as yet un-fired shock tube, i.e., the output shock tube. Accordingly, an incoming signal from either shock tube will ignite the delay element, and after the predetermined delay, detonation of the charge in the device will initiate a signal in the other shock tube, through the wall thereof, exteriorly of the cap. Thus, the device provides a delay in the transfer of a signal between the two shock tubes.

SUMMARY OF THE INVENTION

Generally, the devices of the invention may comprise transmission relay or relay and initiation devices containing a charge which receives an input signal via an input line, e.g., a tube, and generates at the end of an output line, e.g., at the tube end of an output tube, contained within a housing, an output relay signal. The charge may comprise a detonator charge which serves to also initiate an event, in addition to the generation of the output signal, exteriorly of the housing.

Specifically, there is provided in accordance with the present invention a signal transmission device comprising the following elements. A housing having a charge disposed therein and a plurality of signal transmission tubes each having a distal end and an opposite end, the opposite end of the tubes being connected to the housing and comprising at least one input signal transmission line, e.g., an input signal transmission tube ("input tube"), and at least one output signal transmission line, e.g., an output signal transmission tube, ("output tube"). Each line terminates in line ends e.g., tube ends, disposed within the housing. A signal transfer means is included to connect the input line in signal transfer communication with both the output line and the charge such that an input signal transmitted through the input line will initiate detonation of the charge and generate an output relay signal in the output line at the tube end thereof.

In accordance with the present invention the signal transmission lines employed may be low energy detonating cord (described below) or shock tube or LVST tube. In some applications, signal transmission tubes, e.g., shock tubes or LVST tubes, are preferred.

One aspect of the invention provides that the charge comprises a detonator charge for initiating an event externally of the housing upon detonation of the detonator charge.

Another aspect of the invention provides that the signal transfer means comprises delay train means having a delay period and disposed within the housing, the delay train means connecting at least one of the signal transmission tubes in signal transfer relationship with the charge whereby, upon passage of an input signal through the input tube, a time interval determined by the delay period is established between ignition of the delay train means and generation of the output relay signal in the output tube.

In accordance with another aspect of the present invention there is provided a signal transmission line, e.g., tube, relay and initiator device comprising the following elements. A generally cylindrical housing having a closed end and an opposite, open end has a detonator charge disposed at the closed end of the housing for initiating an event externally of and proximate to the closed end of the housing upon detonation of the detonator charge. Each of a plurality of signal transmission lines has a distal end and an opposite end, the opposite ends being connected to the housing at a location remote from the closed end thereof. The signal transmission lines comprise at least one input signal transmission line, e.g., signal transmission tube ("input tube"), and at least one output signal transmission line, e.g., signal transmission tube ("output tube"). The signal transmission lines are retained clear of the exterior of the active end of the housing and terminate in line ends, e.g., tube ends, disposed within the housing. Signal transfer means connect the input line in signal transfer communication with both the output line and the detonator charge in a manner such that an input signal transmitted through the input line will both generate an output relay signal in the output line and initiate detonation of the detonator charge. The signal transfer means comprises a delay train means having a delay period and being disposed within the housing, the delay train means connecting at least one of the signal transmission lines in signal transfer relationship with the detonator charge. In this way, upon passage of an input signal through the input line a time interval determined by the delay period is established between initiation of the detonator charge and either or both of (a) ignition of the delay train and (b) generation of the output relay signal in the output line.

In one aspect of the present invention the distal end of the input line, e.g., input tube, has an igniter device attached thereto.

Specific aspects of the invention provide for a variety of different arrangements as follows, which are described with reference to the preferred (for some applications) transmission tubes but apply to transmission lines as well: (1) the output tube is disposed in non-delay signal transfer relationship with the detonator charge and the delay train means is interposed between the input tube and the detonator charge; or (2) the delay train means is configured to ignite the output tube, the input tube is disposed in non-delay signal transfer relationship with the detonator charge and the delay train is interposed between the output tube and the detonator charge; or (3) the delay train means comprises a first delay train having a first delay period and interposed between the input tube and the detonator charge, and a second delay train having a second delay period and interposed between the output tube and the detonator charge, with the first and second delay periods being either equal or unequal in duration; or (4) the signal transfer means may further comprise a signal transfer charge connecting the tube ends of the input tube and output tube in signal transfer relationship with the delay train means disposed in signal transfer relation between the signal transfer charge and the detonator charge.

The present invention also provides for a detonation system comprising a plurality of the devices described above connected in sequence with the output tube of each device connected in signal transfer communication to the input tube of a succeeding device, with the closed ends of the devices disposed in initiation relationship with respective target charges. The target charges may comprise, for example, the propellant base charges of display pyrotechnic means or of munitions dispersal means, or the explosive charges of a blasting system.

Other aspects of the present invention will become apparent from the following description.

DETAILED DESCRIPTION OF THE INVENTION AND PREFERRED EMBODIMENTS THEREOF

Figure 1:
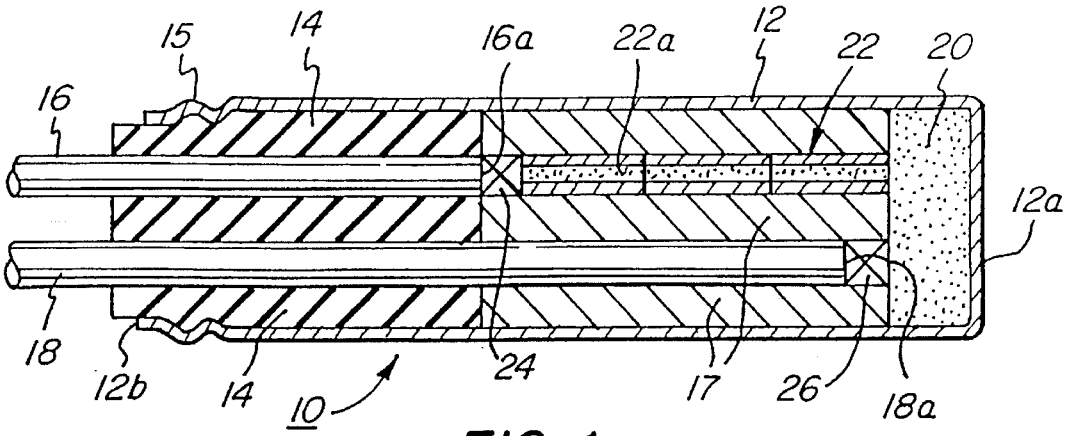
FIGS. 1, 2 and 3 are schematic cross-sectional views, respectively, of signal transmission relay and initiator devices according to three different embodiments of the present invention.

Referring now to FIG. 1 there is shown a signal transmission tube relay and initiator device 10 comprising a generally cylindrical or tube-shaped housing 12 having a closed end 12*a* and an open end 12*b*. A closure bushing 14 has two spaced-apart bores (unnumbered) formed therein and within which are received, respectively, a first signal transmission tube 16 and a second signal transmission tube 18. A cylindrical slug 17, which may be made of a metal such as aluminum, brass or lead or a rigid synthetic organic polymeric material (plastic) is disposed between closure bushing 14 and a detonator charge 20. Like bushing 14, slug 17 has a pair of bores (unnumbered) formed therein to receive tube 18 and a delay train means 22 aligned with tube 16. Housing 12, which may be made of a metal such as aluminum or copper, is crimped at 15 in the known manner to seal closure bushing 14 within housing 12. Usually, the crimp and closure bushing are designed to provide a watertight seal to protect the interior of the housing from the environment, especially moisture. In an alternate construction, housing 12 may be made of cardboard, such as spiral-wound cardboard, which may be waxed or coated with a suitable plastic material to enhance water tightness. In such case, a hot-melt adhesive or any other suitable mechanical or adhesive means, or combination thereof, may be used in lieu of crimp 15 to seal closure bushing 14 within housing 12. The free or distal ends of first tube 16 and second tube 18 are not shown but it will be appreciated that tubes 16 and 18 may be of any suitable length, e.g., from about 2 to 65 meters (about 6.6 to 213 feet). Transmission tubes 16, 18 may comprise shock tubes or LVST tubes. Alternatively, in appropriate applications, a low energy detonating cord, e.g., one having not more than six grains per linear foot of explosive such as PETN, may be employed in lieu of shock tube or LVST tube in appropriate applications. For example, a detonating cord containing 3 to 6 grains of explosive per linear foot may be used. In such case, it may be desirable to enhance the strength of the housing to resist the explosive force of the low energy detonating cord. Signal transmission tube 16 terminates at its opposite end (opposite from the distal end) in a first tube end 16*a* and signal transmission tube 18 terminates at its opposite end in a second tube end 18*a*.

Detonator charge 20 is disposed at the closed end 12*a* of housing 12 and may comprise any suitable material such as an explosive, or combination of explosives, or a flash mixture. For example, detonation charge 20 may comprise a primary charge such as lead azide on the side of detonator charge 20 which is abutted by slug 17, with the balance of detonator charge 20 comprising a high brisance explosive such as PETN, HMX or the like. Alternatively, detonator charge 20 may comprise lead azide or a flash mix such as a mixture of aluminum powder, potassium chlorate and antimony oxide, or zirconium powder and potassium chlorate. The closed end 12*a* of housing 12 which contains the detonator charge 20 is sometimes herein and in the claims referred to as the "active end" of device 10.

A delay train means 22 may comprise any suitable delay train as is well-known in the art, and typically comprises an outer metal, e.g., lead, sheath surrounding a pyrotechnic core 22*a*.

First signal control means 24, illustrated schematically, comprises any suitable means to prevent inadvertent ignition of delay train means 22 by static electricity in signal transmission tube 16. When signal transmission tube 16 is to be employed as an output signal transmission tube ("output tube"), first signal control means 24 may include a small cap charge or the like to facilitate initiation of an output relay signal in signal transmission tube 16 by delay train means 22, as more fully explained below. A second signal control means 26 schematically illustrates the provision of static electricity diversion means employed to prevent a static charge in signal transmission tube 18 from causing an unplanned detonation of detonator charge 20.

In operation, when the signal transmission tube relay and initiator device 10 are used with first signal transmission tube 16 serving as the input signal transmission tube and second signal transmission tube 18 serving as the output transmission tube, an input signal transmitted through input tube 16 ignites the delay train 22 and the delay train 22 initiates the detonator charge 20 after the period of the delay train has lapsed. Initiation of the detonator charge 20 generates an outgoing relay signal in the output tube 18. Thus, with this arrangement, a time interval determined by the delay period is established between receipt of the input signal within the housing 12 at delay train means 22 and initiation of the detonator charge 20. The outgoing signal is generated in output tube 18 by, and simultaneously with, initiation of the detonator charge 20. On the other hand, if second signal transmission tube 18 is utilized as the input tube and first signal transmission tube 16 is utilized as the output tube, an input signal transmitted through the input tube (tube 18 in this case) initiates the detonator charge 20 with no delay period and initiation of the detonator charge 20 ignites the delay train 22. The latter generates the output relay signal in the output tube 16 after the delay period of the delay train lapses. With this arrangement, generation of the output relay signal in the output tube (tube 18 in this case) is delayed after initiation of the detonator charge by a time interval determined by the delay period of the delay train 22. Thus, the delay period time interval is established between initiation of the detonator charge and generation of the output relay signal.

Figure 2:
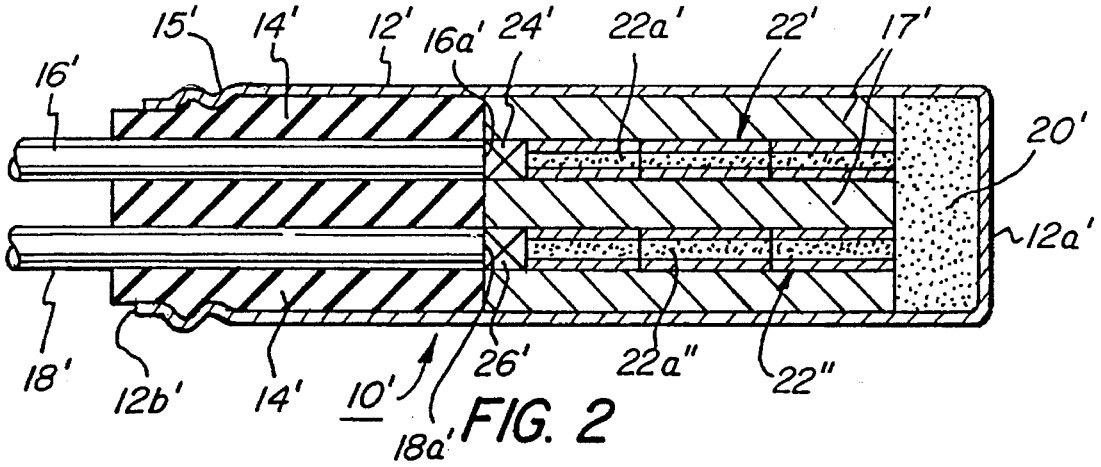

FIG. 2 illustrates another embodiment of the invention wherein parts thereof which are substantially identical to those of FIG. 1 are identically numbered except for the addition of a prime or double prime indicator and repetitive description of such parts is omitted. In this embodiment, second signal transmission tube 18', like first signal transmission tube 16' is connected in signal transfer relation with detonator charge 20' by a second delay train means 22" which has a second signal control means 26' interposed between it and signal transmission tube 18'. With first signal transmission tube 16' serving as the input tube and second signal transmission tube 18' serving as the output tube, an input signal transmitted through the input tube (tube 16' in this case) ignites the first delay train 22' which initiates the detonator charge 20' after the first delay period lapses. Initiation of detonator charge 20' ignites the second delay train 22", which generates an outgoing relay signal in the output tube 18' after the second delay period lapses. The first delay period of the first delay train means 22' may be the same in duration as the second delay period of the second delay train means 22" or the first and second delay periods may be unequal in duration. If the respective first and second delay periods are equal then, of course, the device 10' functions identically regardless of which of tubes 16' or 18' is the input and which is the output tube. If the first and second delay periods are unequal in duration, then the delay period of the tube which is utilized as the input tube will determine the time interval between receipt of the input signal within the housing 12' at the receiving end of the delay train means 22' or 22" as the case may be, and initiation of the detonator charge 20'. The delay period of the delay train associated with the output tube will determine the time interval between initiation of the detonator charge 20' and generation of the output signal in the output tube.

Figure 3:
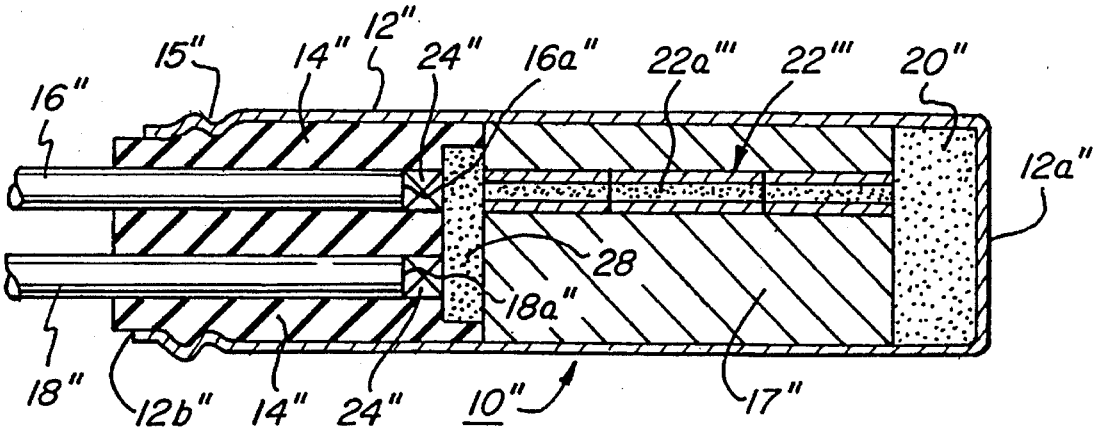

Referring now to FIG. 3, parts thereof which are substantially identical to those of FIG. 1 are identically numbered except for the addition of a double or triple prime indicator, and repetitive description thereof is omitted. In this embodiment, a signal transfer charge 28 is interposed between the terminal ends **16*a*", 18*a*" of first and second signal transmission tubes 16", 18" and delay train means 22'''. Signal transfer charge 28 may comprise any suitable explosive or pyrotechnic material such as PETN, lead azide or a flash composition. In this embodiment, it is immaterial which of first and second signal transmission tubes 16" and 18" is utilized as the input tube and which as the output tube. In either case, when the input signal is received at signal transfer charge 28 the latter is initiated and simultaneously generates the outgoing signal in the other signal transmission tube (the one not used as the input tube) and simultaneously ignites the delay train 22"40 . When the delay period of the delay train 22"40 lapses, a signal is received at detonator charge 20" which is thereupon initiated. With this arrangement, receipt of the input signal within the housing 12" (at the signal transfer charge 28) simultaneously generates the output relay signal and initiation of the detonator charge 20' is delayed by a time interval determined by the delay period of delay train 22'''**.

It will be noted that in the illustrated embodiments, generation of an outgoing relay signal in a signal transmission tube takes place at a terminal end (e.g., **16*a*, 18*a*) of the tube and within the sealed housing. This enables the generation of the outgoing relay signal at an open end of the tube within a sealed, usually water-tight, environment, which provides more reliable generation of the signal than does generation of the signal through an uncut wall of the tube exposed to the environment, as is the case in the above-mentioned U.S. Pat. No. 4,911,076 to Rowe. Because the arrangement of the present invention generates the output relay signal in the output tube or tubes at the open ends thereof disposed within the housing, the minimum strength of the detonator charge, when it is used to generate the output relay signal, is not determined by the strength needed to burst through the housing and through the uncut wall of the tube as is the case with the above-mentioned U.S. Pat. No. 4,911,076 to Rowe. Accordingly, the strength of the detonators of devices of the present invention can be set with consideration solely to an intended end use other than generation of the output relay signal. In fact, Rowe does not disclose any use for the detonator charge other than to generate the output relay signal and the external placement of the tubes at the active end of the Rowe devices may well preclude such other use. The devices of the present invention are capable of initiating an event with the detonator charge independently of generating the output relay signal. Further, the generation of the output relay signal at the open tube end of the output tube or tubes in accordance with the present invention permits generation of the output relay signal by a separate signal transfer charge, as illustrated by item 28 of FIG. 3**. By thus freeing the detonator charge of a role in generating the output relay signal, the detonator charge and active end of the device can be designed based solely on considerations germane to initiation of the planned external event by the detonator charge.

Figure 4:
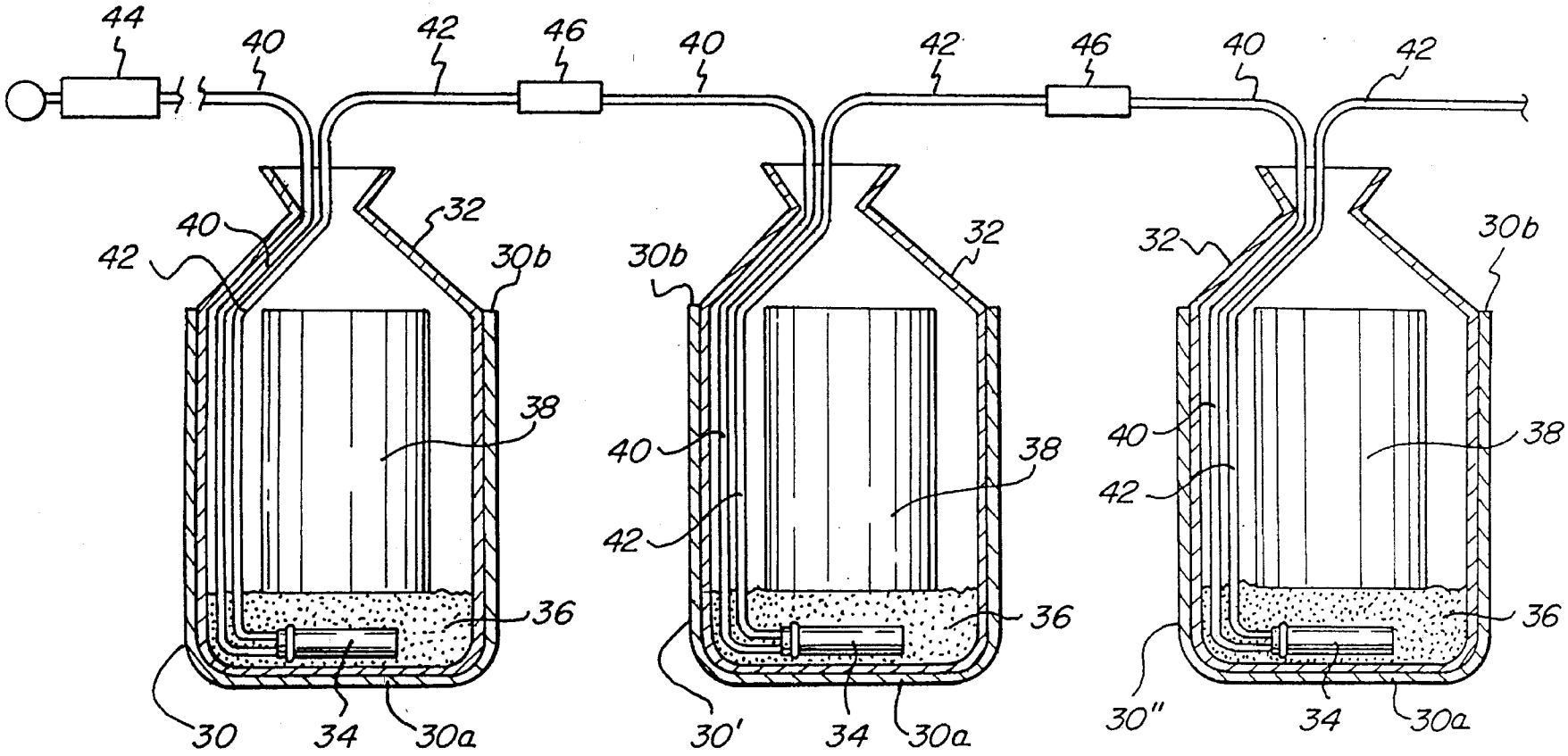
FIG. 4 is a schematic view of a detonation system in accordance with one embodiment of the present invention.

FIG. 4 schematically illustrates a detonation system comprising a plurality of devices such as any of those illustrated in FIG. 1, 2 or 3, connected in series in an application for timed ignition of a plurality of pyrotechnic aerial shell devices. Such interconnected devices, in any desired pattern, may of course be used for any suitable purpose including, without limitation, initiation of a sequence of explosive charges in civil or military blasting or detonation operation, in demolition blasting, in the sequential ejection of munitions, pyrotechnics or the like from pod-like carriers for the same, etc.

Thus, a series of pyrotechnic launch tubes or mortars 30, 30' and 30" have respective bases 30*a* and opposite open ends 30*b* from which protrude the closures of paper bags 32. A signal transmission tube relay and initiator device 34 is positioned within each pyrotechnic launch tube 30 at or adjacent the base 30*a* thereof and is embedded within a pulverulent propellant base charge 36, for example, black powder. Base charges 36, upon initiation by devices 34, will propel lift charges 38 upwardly to an elevation high enough that initiation of the lift charges 38 (by any suitable self-contained delay fuse devices as is well-known in the pyrotechnic art) will occur at a suitable altitude for pyrotechnic display purposes. The distal end of the input tube 40 of the device 34 contained within the first mortar 30 is connected to a suitable igniter device 44. The output tube 42 of the device 34 within first mortar 30 extends outwardly of its associated paper bag 32 and is connected in signal transfer relation to the input tube 40 of the device 34 contained within second mortar 30' by a signal transfer connector 46 which, as is well-known in the art, may comprise a simple tube connector which places the distal ends of connected tubes 42 and 40 in signal transfer relation to each other. Output tube 42 is similarly connected in signal transfer communication by another signal transfer connector 46 to input tube 40 of the device 34 contained within mortar 30". It will be appreciated that an indefinite number of mortars may thus be connected in series. It will further be appreciated that signal transfer connectors 46 may be three-way or four-way connectors so that more complex interconnections may be made to other mortar shells rather than a simple series connection as illustrated.

Generally, with an arrangement as illustrated in FIG. 4, an input signal is generated in tube 40 associated with mortar 30 by operation of igniter device 44, and is received by the device 34 contained in the first mortar 30 of the series. The input signal both initiates the detonator charge of device 34 in mortar 30 and generates an outgoing signal in the output signal transmission tube 42 emerging from mortar 30 with a selected delay attained as described with reference to FIGS. 1–3, so that an initiation signal passes from device 34 of mortar 30 to device 34 of mortar 30' and so on, igniting any number of devices in succession with a selected delay between events.

The delay durations of the devices 34 may be such that the input signal is fed to a plurality of interconnected devices 34 before detonation of the detonator charge of the initial device. This permits the signal to propagate a sufficient distance "downstream" from a target charge before that target charge is initiated, and thus serves to prevent the disruption caused by detonation of a given target charge from interrupting the transmission of the signal to a subsequent charge. In the context of the display fireworks arrangement of FIG. 4, such disruption might be caused by dislodgment of a connecting tube 40 or 42 upon the lift charge 38 being propelled from its associated mortar. If the charges to be initiated are blasting charges, propagation of the signal a distance away from a given target charge before initiation thereof similarly helps to preclude disruption of the signal by severing of a signal transmission tube by shrapnel generated by the initial blast. Initiation signals generally propagate through shock tubes at approximately 2,000 meters ("m") per second, equivalent to approximately 6,560 feet ("ft") per second. The speed of initiation signals in LVST tube is, as noted above, about one-third as great as that in shock tube, i.e., about 670 m per second, equivalent to about 2,180 ft per second.

While the invention has been described in detail with respect to specific preferred embodiments thereof, it is to be understood that upon a reading of the foregoing description, variations to the specific embodiments disclosed may occur to those skilled in the art and it is intended to include such variations within the scope of the appended claims.

What is claimed is:

1. A signal transmission line device comprising:

a housing having a charge disposed therein;

a plurality of signal transmission lines each containing therein a solid, signal-transmitting substance and having a distal end and an opposite, line end, the signal transmission lines being connected to the housing and comprising at least one input signal transmission line ("input line") and at least one output signal transmission line, ("output line"), each signal transmission line terminating in a respective said line end disposed within the housing;

signal transfer means connecting the input line in signal transfer communication with both the output line and the charge such that an input signal transmitted through the input line will initiate both detonation of the charge and initiation of the signal transmission means to generate at the line end of the output line an output relay signal.

2. The device of claim 1 wherein the charge comprises a detonator charge for initiating an event externally of the housing upon detonation of the detonator charge.

3. A signal transmission line device comprising:

a housing having a charge disposed therein;

a plurality of signal transmission lines each having a distal end and an opposite, line end, the signal transmission lines being connected to the housing and comprising at least one input signal transmission line ("input line") and at least one output signal transmission line, ("output line"), each signal transmission line terminating in a respective said line end disposed within the housing; and signal transfer means connecting the input line in signal transfer communication with both the output line and the charge such that an input signal transmitted through the input line will initiate both detonation of the charge and initiation of the signal transmission means to generate at the line end of the output line an output relay signal, the signal transfer means comprising delay train means having a delay period and disposed within the housing, the delay train means connecting at least one of the signal transmission lines in signal transfer relationship with the charge whereby upon passage of an input signal through the input line a time interval determined by the delay period is established between ignition of the delay train means and generation of the output relay signal in the output line.

4. The device of claim 3 wherein the charge comprises a detonator charge for initiating an event externally of the housing upon detonation of the detonator charge, whereby upon passage of a input signal through the input line a time interval determined by the delay period is established between initiation of the detonator charge and at least one of (a) ignition of the delay train means and (b) generation of the output relay signal in the output line.

5. A signal transmission line device comprising:

a generally cylindrical housing having a closed end and an opposite, open end;

a detonator charge disposed at the closed end of the housing for initiating an event externally of and proximate to the closed end of the housing upon detonation of the detonator charge;

a plurality of signal transmission lines each containing therein a solid, signal transmitting substance and having a distal end and an opposite, line end, the signal transmission lines being connected to the housing at a location remote from the closed end thereof and comprising at least one input signal transmission line ("input line") and at least one output signal transmission line, ("output line"), the signal transmission lines being retained clear of the exterior of the active end of the housing and terminating in a respective said line end disposed within the housing; and signal transfer means connecting the input line in signal transfer communication with both the output line and the detonator charge such that an input signal transmitted through the input line will both initiate the signal transfer means to generate via the signal transfer means an output relay signal in the output line at the line end thereof and initiate detonation of the detonator charge, the signal transfer means comprising delay train means having a delay period and disposed within the housing, the delay train means connecting at least one of the signal transmission lines in signal transfer relationship with the detonator whereby upon passage of an input signal through the input line a time interval determined by the delay period is established between initiation of the detonator charge and at least one of (a) ignition of the delay train means and (b) generation of the output relay signal in the output line.

6. The device of any one of claims 1 through 5 wherein the signal transmission lines comprise signal transmission tubes, whereby the input line comprises an input tube, the output line comprises an output tube and the line ends comprise tube ends.

7. The device of claim 1 or claim 5 wherein the distal end of the input line has an igniter device affixed thereto.

8. The device of claim 5 wherein the signal transmission lines comprise signal transmission tubes, whereby the input line comprises an input tube, the output line comprises an output tube and the line ends comprise tube ends.

9. A signal transmission line device comprising:

a generally cylindrical housing having a closed end and an opposite, open end;

a detonator charge disposed at the closed end of the housing for initiating an event externally of and proximate to the closed end of the housing upon detonation of the detonator charge;

a plurality of signal transmission lines each having a distal end and an opposite, line end, the signal transmission lines being connected to the housing at a location remote from the closed end thereof and comprising at least one input signal transmission line ("input line") and at least one output signal transmission line, ("output line"), the signal transmission lines being retained clear of the exterior of the active end of the housing and terminating in a respective said line end disposed within the housing; and signal transfer means connecting the input line in signal transfer communication with both the output line and the detonator charge such that an input signal transmitted through the input line will both initiate the signal transfer means to generate via the signal transfer means an output relay signal in the output line at the line end thereof and initiate detonation of the detonator charge, the signal transfer means comprising delay train means having a delay period and disposed within the housing, the output line being disposed in non-delay signal transfer relationship with the detonator charge and the delay train means being interposed between the input line and the detonator charge in signal transfer relationship therewith whereby, upon passage of an input signal through the input line a time interval determined by the delay period is established between initiation of the detonator charge and at least one of (a) ignition of the delay train means and (b) generation of the output relay signal in the output line.

10. The device of claim 8 wherein the input tube is disposed in non-delay signal transfer relationship with the detonator charge and the delay train is interposed between the output tube and the detonator charge.

11. The device of claim 8 wherein the delay train means comprises a first delay train having a first delay period and interposed between the input tube and the detonator charge and a second delay train having a second delay period and interposed between the output tube and the detonator charge.

12. The device of claim 11 wherein the first delay period is equal in duration to the second delay period.

13. The device of claim 11 wherein the first delay period and the second delay period are unequal in duration.

14. The device of claim 8 wherein the signal transfer means further comprises a signal transfer charge connecting the tube ends of the input tube and output tube in signal transfer relationship.

15. The device of claim 14 wherein the delay train means is disposed in signal transfer relation between the signal transfer charge and the detonator charge.

16. A detonation system comprising a plurality of the devices of claim 2 or claim 4 connected in sequence with the output line of each device connected in signal transfer communication to the input line of a succeeding device and the devices are disposed in initiation relationship with respective target charges.

17. The detonation system of claim 16 wherein the target charges comprise the propellant base charges of aerial display pyrotechnic means.

18. A detonation system comprising a plurality of the devices of claim 8 connected in sequence with the output tube of each device connected in signal transfer communication to the output tube of a succeeding device and the devices are disposed in initiation relationship with respective target charges.

19. The detonation system of claim 18 wherein the target charges comprise the propellant base charges of aerial display pyrotechnic means.

20. The signal transmission line device of claim 1 wherein the signal transmission lines are retained clear of the portion of the housing having the charge disposed therein.

21. The signal transmission line device of claim 9 wherein the signal transmission lines comprise signal transmission tubes, whereby the input line comprises an input tube, the output line comprises an output tube and the line ends comprise tube ends.

* * * * *

UNITED STATES PATENT AND TRADEMARK OFFICE

CERTIFICATE OF CORRECTION

PATENT NO. : 5,515,784

DATED : May 14, 1996

INVENTOR(S) : Richard J. Peebles

It is certified that error appears in the above-indentified patent and that said Letters Patent is hereby corrected as shown below:

Column 6, line 17, replace "22''40" with --22'''--

Column 6, line 18, replace "22''40" with --22'''--

Column 8, line 21, after "housing;" insert --and--

Column 8, line 60, replace "a" with --an--

Signed and Sealed this

Tenth Day of September, 1996

*Attest:*

BRUCE LEHMAN

*Attesting Officer*

*Commissioner of Patents and Trademarks*